United States Patent [19]

Bochynsky et al.

[11] 4,017,906

[45] Apr. 19, 1977

[54] PROTECTIVE GARMENT FOR THE FACE

[75] Inventors: Frank J. Bochynsky, Highland Park; George J. Przybylek, Martinsville, both of N.J.

[73] Assignee: The Byke Co., Highland Park, N.J.

[22] Filed: May 28, 1975

[21] Appl. No.: 570,003

[52] U.S. Cl. ..... 2/10; 2/205

[51] Int. Cl.[2] ..... A42B 3/00

[58] Field of Search ..... 2/10, 9, 6, 203, 173, 2/14 B, 205

[56] References Cited

UNITED STATES PATENTS

| | | | |
|---|---|---|---|
| 1,164,351 | 12/1915 | Hultstrom | 2/10 X |
| 1,222,995 | 4/1917 | Rhoades | 2/10 X |
| 1,251,657 | 1/1918 | Hart | 2/205 X |
| 1,701,015 | 2/1929 | Shepard | 2/14 B |
| 3,668,705 | 6/1972 | Garbisch | 2/10 |
| 3,806,951 | 4/1974 | Halteman | 2/6 |
| 3,825,952 | 7/1974 | Pershing | 2/205 X |

*Primary Examiner*—Werner H. Schroeder
*Assistant Examiner*—Peter Nerbun

[57] ABSTRACT

The garment includes a collar portion to be worn around the neck and an auxiliary porous shield portion which is adapted to be raised in front of the face and secured along its edge to the lower edge of the visor portion of a helmet of the type worn by motorcycle riders.

7 Claims, 8 Drawing Figures

Fig. 1
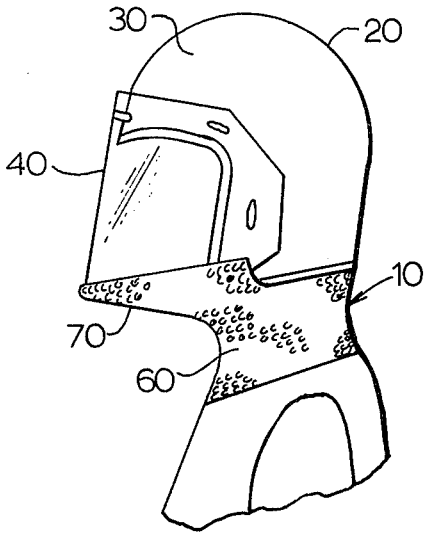
Fig. 3
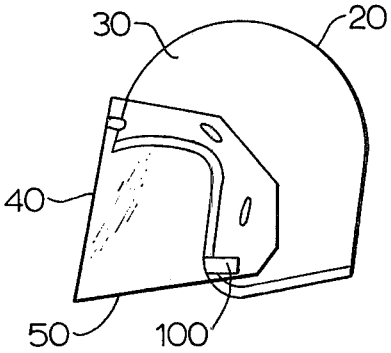
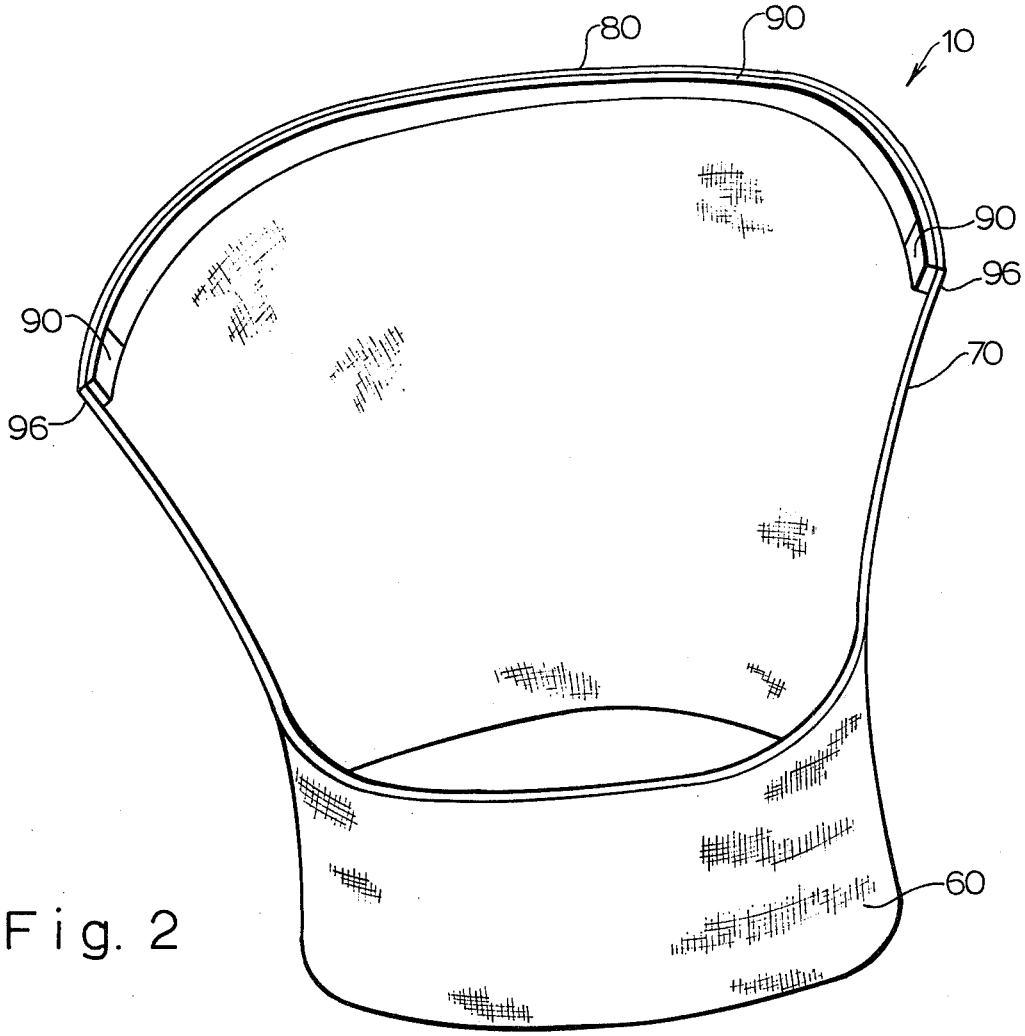
Fig. 2

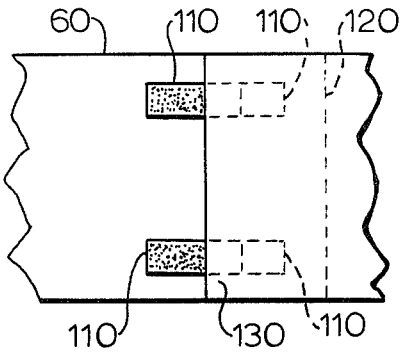
Fig. 4
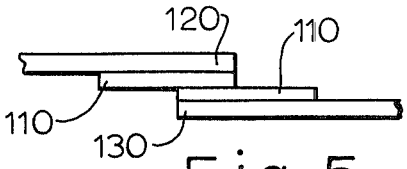
Fig. 5
Fig. 6
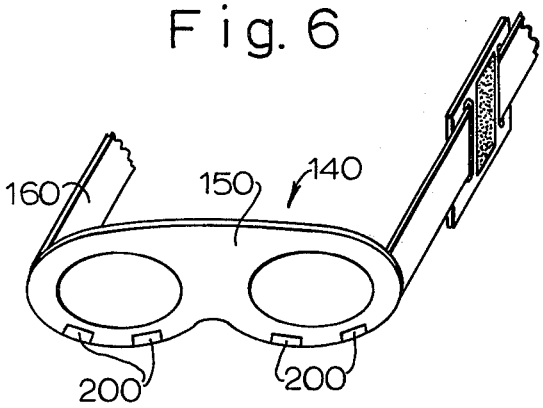
Fig. 7
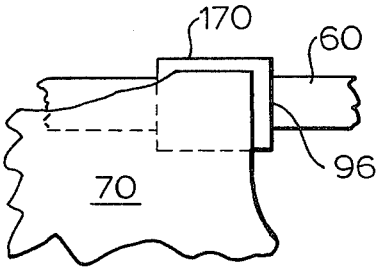
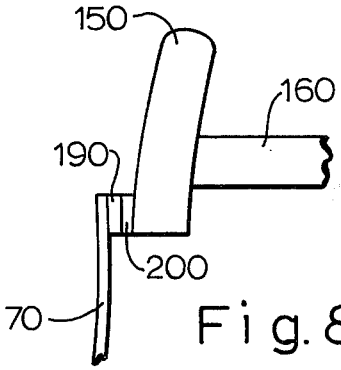
Fig. 8

PROTECTIVE GARMENT FOR THE FACE

BACKGROUND OF THE INVENTION

It has been found that, with the helmets worn by motorcycle riders which include a face shield, wind currents swirl up under the face shield and over the face. For a motorcycle rider riding in warm weather, such wind currents are not uncomfortable; however, during cold weather, it is almost impossible to ride for any great distance.

SUMMARY OF THE INVENTION

Briefly, the garment embodying the invention includes a neck portion and a shield portion which is removably secured to a helmet or other apparatus worn by the individual wearing the garment and which prevents wind currents from reaching the face of the wearer.

DESCRIPTION OF THE DRAWINGS

FIG. 1 is a side elevational view of a garment embodying the invention as it appears when worn;

FIG. 2 is a rear view of the garment of the invention;

FIG. 3 is a side elevational view of a helmet for use with the invention;

FIG. 4 is a side elevational view of a portion of the garment of the invention showing a modification thereof;

FIG. 5 is a plan view of the garment of FIG. 4;

FIG. 6 shows another type of apparatus with which the invention can be used;

FIG. 7 shows a portion of the garment of the invention combined with the apparatus of FIG. 6; and FIG. 8 is a side elevational view of the apparatus of FIGS. 6 and 7 combined.

DESCRIPTION OF THE PREFERRED EMBODIMENTS

A protective garment 10 embodying the invention, referring to FIG. 1, is adapted to be used with a helmet 20 of the type worn by motorcycle riders. Such a helmet includes a head portion 30 and a transparent face shield 40. The face shield covers the face and has a lower edge 50 which is normally positioned at about the level of the chin of the wearer or perhaps somewhat lower.

The garment 10 is made of wool, a double-knit acrylic material, or the like, which is preferably somewhat elastic and somewhat porous. The garment includes a tubular portion 60 which is adapted to encircle the neck of the wearer,and a shield or flap 70. The tubular portion 60 and flap 70 may be one piece or two separate pieces sewed together. If they are two pieces, the lower edge of the flap is secured to a portion of the upper edge of the collar at the portion thereof which is to be positioned below the face of the wearer.

The shield or flap 70 has an upper edge 80, to the inner portion of which is secured a length of elastic material 90. The ends 96 of the upper edge of the flap are adapted to be physically secured to the sides of the lower edge 50 of the shield 40 of the helmet to thereby close off the open space between the shield and the face of the wearer, while the remainder of this edge forms a tight fit and thus holds to the edge of the shield 40. The flap 70 is preferably of such a size that it forms a tight fit over the lower edge of the shield, and its ends may be secured thereto in any suitable fashion. In one suitable arrangement, the ends 96 of the flap carry a small piece 90 of an adhesive fabric such as Velcro, and the face shield, at its sides, carries similar matching pieces 100, and the pieces 90 on the flap can be secured by pressure contact to the pieces 100 on the face plate to secure the flap in place.

The garment 10 is used by placing the neck portion 60 around the neck of the wearer, and then the ends of the flap are secured to the edges of the face plate by means of the connectors 90 and 100. Then the upper edge 80 of the flap is stretched over the lower edge 50 of the face shield 40.

With the garment thus secured, drafts cannot flow up between the face shield and the face of the wearer, but, since the flap is porous,the wearer can take in and expel air therethrough.

Various modifications in the specific structural features described above may be made within the scope of the invention. For example, metal snaps or the like may be used to secure the flap 70 to the face shield 40.

In a modification of the invention illustrated in FIGS. 4 and 5, the neck portion 60 is formed, not as a closed tube, but as a length of material which can be wound about the neck of the wearer where it is secured in place, as a collar, by any suitable fastening means. The fastening means may be typical garment hook-and-eye arrangements (not shown), or, if desired, strips 110 of fastening material, such as Velcro, may be sewed to the ends 120 and 130 of the length of material, and then the ends are overlapped and secured together by means of the Velcro strips which stick to each other.

Fastening means, such as Velcro, comprises two mating strips of fabric, each strip having a different surface texture, one surface being formed with loops and the other surface being formed with hooks, the two strips thus formed adhering firmly to each other.

The garment of the invention may also be attached to goggles 140 of the type which include a frame 150 and relatively wide fabric strap 160 which encircles the head of the wearer. In one arrangement, a pair of slider strips 170 of fabric (one is shown in FIG. 7) having two spaced-apart parallel slots 180 are slidably mounted on the goggles strap 160, and a square of Velcro 190 is secured to each fabric slider 170 between the slots 180. The ends 96 of the flap 70 of the garment 10 can be secured to the Velcro square (FIG. 8), and the flap can be adjusted by suitably positioning the fabric sliders on the goggles strap 160. Of cours, Velcro strips may be secured directly to strap 160.

In addition, referring to FIGS. 6 and 9, for use with goggles,the inside surface of the upper free edge of the flap 70 of garment 10 which carries the elastic, is provided with fastening means such as one or more strips of Velcro 190 which can be attached to a comparable number of strips of Velcro 200 on the lower edge of the frame of the goggles. This fixes the flap 70 in protective position in front of the face of the user.

What is claimed is:

1. A cold weather garment comprising a first relatively wide collar portion to be worn on and surrounding the neck and shaped to cover the neck of an individual for providing warming muffler action therefor, said collar portion having a lower edge and an upper edge, said collar portion being made of fabric, a second portion made of a stretchable fabric and comprising a flap, said flap having a lower edge which is secured to a portion of the upper edge of said first collar portion, said flap thus being adapted to be raised and lowered with respect to said first collar portion, said flap having an inner surface and an outer surface, said flap being generally rectangular in shape and having an upper edge spaced from its lower edge and from said first collar portion, said flap being extendible from side collar portion so that said upper edge of said flap can engage the outer surface of the face shield of a helmet worn by the individual whereby said flap blocks the open space between the face of the individual and the face shield of the helmet and prevents excessive wind from entering said space, the upper edge of said flap portion having a first end and a second end spaced apart from each other, a length of elastic secured to said upper edge of said flap portion and extending along substantially the entire length of said upper edge from said first end to said second end, the upper edge of said flap and said elastic being adapted to be stretched and placed in tension, and fastening means secured to the inner surface of said first and second ends of the upper edge of said flap portion, said fastening means being adapted to be secured to spaced-apart portions of the outer surface of the face shield of a helmet worn by the individual with said elastic and the upper edge of said flap stretched and in tension, the attachment of said first and second ends of said upper edge of said flap to the spaced-apart portions of the outer surface of said face shield permitting the remainder of said upper edge of said flap either to be stretched and placed in engagement with the outer surface of the face shield or removed from engagement with the outer surface of the face shield.

2. The apparatus defined in claim 1 wherein said fastening means comprises two pairs of matching pieces of fabric, one pair having a loop surface and the other having a hook surface, one pair being secured to said flap, and the other pair being secured to auxiliary apparatus worn by the individual.

3. The apparatus defined in claim 1 wherein said collar portion is a rectangular piece of material having opposite ends which carry fastening means which permit said ends to be secured to each other to form a closed collar about the neck of an individual.

4. A cold weather garment for use by an individual wearing a helmet having a face shield which is generally U-shaped and has a lower edge which extends from the left side to the right side of the face of the individual at about the neck of the individual, the face shield being spaced from the face to provide an open space between the face and the face shield, said garment comprising a first relatively wide collar portion to be worn on and surrounding the neck and shaped to cover the neck of the individual for providing warming muffler action therefor, said collar portion having a lower edge and an upper edge, said collar portion being made of a fabric, a second portion made of a stretchable fabric and comprising a flap, said flap having a lower edge which is secured to a portion of the upper edge of said first collar portion, said flap thus being adapted to be raised and lowered with respect to said first collar portion, said flap having an inner surface and an outer surface, said flap being generally rectangular in shape and having an upper edge spaced from its lower edge and from said first collar portion, said flap being extendible from said collar portion so that said upper edge of said flap can engage the outer surface of the face shield of the helmet whereby said flap blocks the open space between the face of the individual and the face shield of the helmet and prevents excessive wind from entering said space, the upper edge of said flap portion having a first end and a second end spaced apart from each other, a length of elastic secured to said upper edge of said flap portion and extending along substantially the entire length of said upper edge from said first end to said second end, the upper edge of said flap and said elastic being adapted to be stretched and placed in tension, and fastening means secured to the inner surface of said first and second ends of the upper edge of said flap portion, said fastening means being adapted to be secured to spaced-apart portions of the outer surface of the face shield of the helmet worn by the individual with said elastic and the upper edge of said flap stretched and in tension, the attachment of said first and second ends of said upper edge of said flap to the spaced-apart portions of the outer surface of said face shield permitting the remainder of said upper edge of said flap either to be stretched and placed in engagement with the outer surface of the face shield or removed from engagement with the outer surface of the face shield. pg,12

5. The apparatus defined in claim 4 wherein a portion of said fastening means is cemented to said face shield.

6. The apparatus defined in claim 4 wherein said collar portion is a rectangular piece of material having opposite ends which carry fastening means which permit said ends to be secured to each other to form a closed collar about the neck of an individual.

7. Wind screen apparatus for use by an individual including a helmet having a face shield which is generally U-shaped and has a lower edge which extends from the left side to the right side of the face of the individual at about the neck of the individual, the face shield being spaced from the face of the individual to provide an open space between the face and the face shield, said face shield having an outer surface, a garment to be worn by the individual comprising a first relatively wide collar portion to be worn on and surrounding the neck and shaped to cover the neck of the individual for providing warming muffler action therefor, said collar portion having a lower edge and an upper edge, said collar portion being made of a fabric, a second portion made of a stretchable fabric and comprising a flap, said flap having a lower edge which is secured to a portion of the upper edge of said first collar portion, said flap thus being adapted to be raised and lowered with respect to said first collar portion, said flap having an inner surface and an outer surface, said flap being generally rectangular in shape and having an upper edge spaced from its lower edge and from said first collar portion, said flap being extendible from said collar portion so that said upper edge of said flap can engage said outer surface of said face shield whereby said flap blocks the open space between the face of the individual and the face shield of the helmet and prevents excessive wind from entering said space, the upper edge of said flap portion having a first end and a second end spaced apart from each other, a length of elastic secured to said upper edge of said flap portion and extending along substantially the entire length of said upper edge from said first end to said second end thereof, the upper edge of said flap and said elastic being adapted to be stretched and placed in tension, and fastening means secured to the inner surface of said first and second ends of the upper edge of said flap portion, said fastening means being adapted to be secured to spaced-apart portions of the outer surface of said face shield of said helmet at the left and right sides thereof, with said elastic and the upper edge of said flap stretched and in tension, the attachment of said first and second ends of said upper edge of said flap to said spaced-apart portions of the outer surface of said face shield permitting the remainder of said upper edge of said flap either to be stretched and placed in engagement with the outer surface of the lower edge of the face shield or removed from engagement with the lower edge of the outer surface of the face shield.

* * * * *